US007585335B2

(12) United States Patent
Arimura

(10) Patent No.: US 7,585,335 B2
(45) Date of Patent: Sep. 8, 2009

(54) FUEL FOR FUEL CELL

(75) Inventor: Tomoaki Arimura, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 629 days.

(21) Appl. No.: 11/285,596

(22) Filed: Nov. 22, 2005

(65) Prior Publication Data

US 2006/0112613 A1 Jun. 1, 2006

(30) Foreign Application Priority Data

Nov. 30, 2004 (JP) ..... 2004-346562

(51) Int. Cl.
*C10L 1/10* (2006.01)

(52) U.S. Cl. ..... 44/300; 44/301; 44/601

(58) Field of Classification Search ..... 429/306, 429/213, 220, 44, 30, 221, 224, 33; 106/31.43, 106/31.36, 31.57, 31.58, 31.59, 31.67, 31.68; 44/601, 441, 436, 300, 30
See application file for complete search history.

(56) References Cited

U.S. PATENT DOCUMENTS 5,709,737 A * 1/1998 Malhotra et al. ..... 106/31.43
2003/0235737 A1 * 12/2003 Jeon et al. ..... 429/30

FOREIGN PATENT DOCUMENTS

JP 09-110771 4/1997
JP 2004-006335 1/2004
JP 2004-164971 6/2004

* cited by examiner

*Primary Examiner*—Cephia D Toomer
*Assistant Examiner*—Latosha Hines
(74) *Attorney, Agent, or Firm*—Blakely, Sokoloff, Taylor & Zafman LLP

(57) ABSTRACT

A fuel for a fuel cell comprises a mixed solution of water and methanol, and an organic compound represented by the following formula (I) dissolved in the mixed solution as an antifreeze:

$$(OH)_m—R^1—R^2—(OH)_n \quad (I)$$

where $R^1$ and $R^2$ each denote a radical having an indan or indene structure, which are either the same or different; and m and n are integers of 1 to 20.

7 Claims, 1 Drawing Sheet

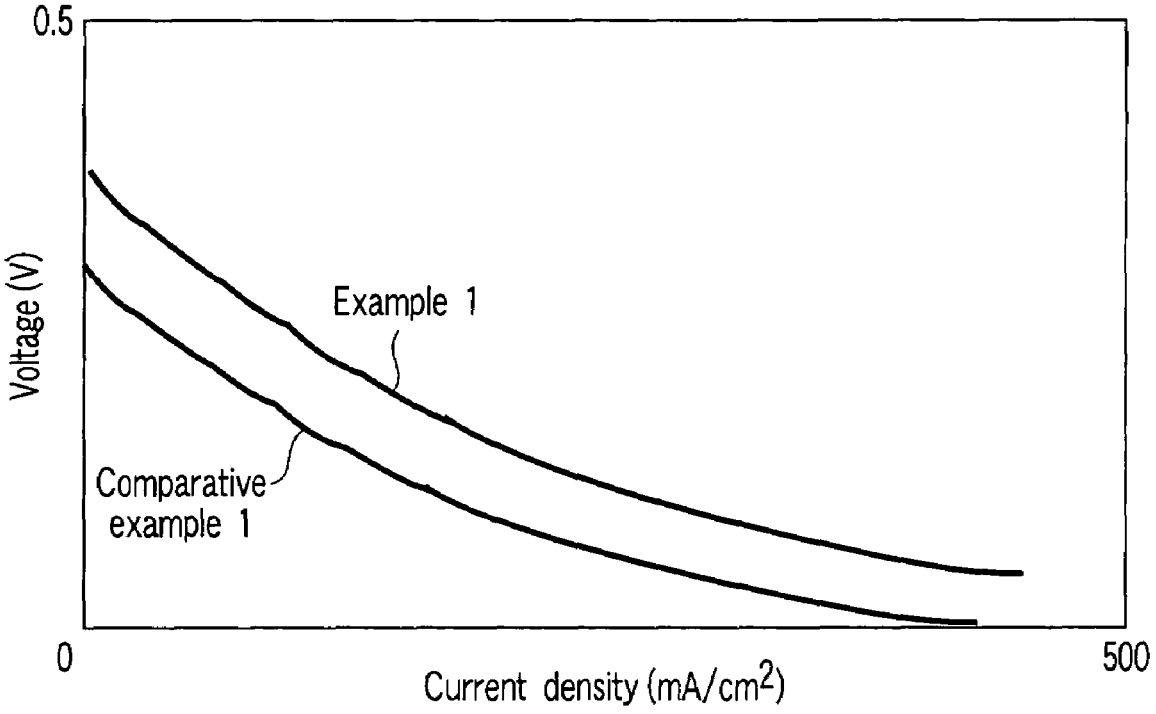
FIGURE

FUEL FOR FUEL CELL

CROSS-REFERENCE TO THE RELATED APPLICATIONS

This application is based upon and claims the benefit of priority from the prior Japanese Patent Application No. 2004-346562, filed Nov. 30, 2004, the entire contents of which are incorporated herein by reference.

BACKGROUND

1. Field

The present invention relates to a fuel for a fuel cell, and more particularly to a fuel for use in a fuel cell such as a direct methanol fuel cell (DMFC) of the active type.

2. Description of the Related Art

An active type DMFC of this kind is a voltaic cell comprising an anode (fuel electrode) to which a mixed solution of water and methanol is supplied as a fuel, a cathode (air electrode) to which an oxidizing agent (oxygen, air) is supplied, and a polymer electrolyte membrane interposed between the anode and the cathode. The anode is composed of a catalyst layer which contacts with the polymer electrolyte membrane, and a diffusion layer such as a carbon paper laminated on the catalyst layer. The cathode is composed of a catalyst layer which contacts with the polymer electrolyte membrane, and a diffusion layer such as a carbon paper laminated on the catalyst layer.

When the active type DMFC operates in a low temperature environment such as a cold district, the fuel, that is, the mixed solution of water and methanol freezes, and the output is lowered.

Hence, Jpn. Pat. Appln. KOKAI Publication No. 2004-6335 discloses that a fuel for a fuel cell is prepared by adding polyhydric alcohol such as ethylene glycol or propylene glycol as an antifreeze to a mixed solution of water and methanol. However, when the fuel having polyhydric alcohol such as ethylene glycol or propylene glycol added thereto is supplied to an anode (fuel electrode) of the fuel cell, a catalyst of the fuel electrode (for example, a platinum-ruthenium catalyst) is poisoned, and the output of the fuel cell is lowered.

BRIEF DESCRIPTION OF THE SEVERAL VIEWS OF THE DRAWING

FIGURE is a view showing a current-voltage characteristic when fuels of Example 1 and Comparative example 1 are applied in a single cell at −30° C.

DETAILED DESCRIPTION OF THE INVENTION

A fuel for a fuel cell according to one embodiment of the invention will be specifically described below.

The fuel for a fuel cell according to the embodiment comprises a mixed solution of water and methanol, and an organic compound represented by the following formula (I) dissolved in the mixed solution as an antifreeze:

$$(OH)_m—R^1—R^2—(OH)_n \quad (I)$$

where $R^1$ and $R^2$ each denote a radical having an indan or indene structure, which are either the same or different; and m and n are integers of 1 to 20.

The fuel of the embodiment is applied in an active type DMFC.

The methanol concentration of the mixed solution is 30 wt. % or less, and preferably 5 to 30 wt. %.

$R^1$ and $R^2$ in the formula (I) each are preferred to be a functional group having a hydroxy indan skeleton, and m and n in the formula (I) are preferred to be integers of 2 to 10.

The organic compound is preferred to be dissolved in the mixed solution by 10 wt. % or less. In the case where the fuel is supplied to the fuel electrode of the fuel cell when the content of the organic compound exceeds 10 wt. %, the organic compound reacts with the catalyst of the fuel cell (for example, the platinum-ruthenium catalyst) to produce another compound, and the catalyst function on methanol in the fuel is lowered, so that the output voltage may drop. A more preferred content of the organic compound in the mixed solution is 0.5 to 5 wt. %.

The organic compound is particularly preferred to be represented by the following formula (II):

(II)

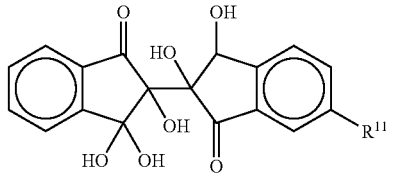

where $R^{11}$ denotes a hydrogen, a carboxy group, an alkoxy group, or an ester group.

$R^{11}$ in the formula (II) is preferably a hydrogen, a carboxy group, or an alkoxy group, and particularly, an alkoxy group having 1 to 20 carbon atoms is preferred. Specific examples of the organic compound represented by the formula (II) include 2,2',3,3',3'-hexahydroxy-2,2'-bi-indan-1,1'-dion, 2,2',3,3',3'-hexahydroxy-2,2'-bi-indan-6-methoxy-1,1'-dion, and 2,2',3,3',3'-hexahydroxy-2,2'-bi-indan-6-carboxy-1,1'-dion. These organic compounds may be used either alone or as a mixture of two or more types.

The fuel for a fuel cell according to the embodiment described herein comprises a mixed solution of water and methanol, and an organic compound, which is represented by the formula (I), having a bi-indan or bi-indene structure of low polar molecules dissolved in the mixed solution as an antifreeze. Accordingly, when supplied to the fuel electrode of the fuel cell, poisoning on the catalyst surface can be avoided.

Moreover, the organic compound represented by the formula (I) has a higher antifreeze effect due to several hydroxy groups (OH groups) existing in one molecule, and therefore, by adding and dissolving the organic compound in the mixed solution of water and methanol, a fuel for a fuel cell which prevents freezing in a low temperature range can be obtained.

In particular, for example, 2,2',3,3',3'-hexahydroxy-2,2'-bi-indan-1,1'-dion represented by the formula (II) is used as the organic compound, whereby, when supplied to the fuel electrode of the fuel cell, poisoning on the catalyst surface of the fuel electrode can be securely avoided, and a fuel for a fuel cell which prevents freezing at a lower temperature (for example, −30° C.) can be obtained.

By dissolving the organic compound in the mixed solution by 10 wt. % or less, a fuel for a fuel cell capable of avoiding poisoning on the catalyst surface of the fuel electrode more securely when supplied to the fuel electrode of the fuel cell can be obtained.

Examples of the invention will be specifically described below.

EXAMPLE 1

In an aqueous methanol solution of 10 wt. % concentration having water (purified water) and methanol mixed therein, 2,2',3,3',3'-hexahydroxy-2,2'-bi-indan-1,1'-dion shown in the following structural formula (A) was dissolved by 1 wt. % as an antifreeze, and a fuel for a fuel cell was prepared.

(A)

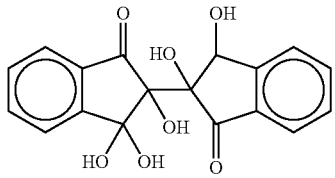

EXAMPLE 2

In an aqueous methanol solution of 5 wt. % concentration having purified water and methanol mixed therein, 2,2',3,3', 3'-hexahydroxy-2,2'-bi-indan-1,1'-dion shown in the above structural formula (A) was dissolved by 0.2 wt. % as an antifreeze, and a fuel for a fuel cell was prepared.

EXAMPLE 3

In an aqueous methanol solution of 5 wt. % concentration having purified water and methanol mixed therein, 2,2',3,3', 3'-hexahydroxy-2,2'-bi-indan-1,1'-dion shown in the above structural formula (A) was dissolved by 3 wt. % as an anti-freeze, and a fuel for a fuel cell was prepared.

EXAMPLE 4

In an aqueous methanol solution of 15 wt. % concentration having purified water and methanol mixed therein, 2,2',3,3', 3'-hexahydroxy-2,2'-bi-indan-1,1'-dion shown in the above structural formula (A) was dissolved by 10 wt. % as an anti-freeze, and a fuel for a fuel cell was prepared.

EXAMPLE 5

In an aqueous methanol solution of 10 wt. % concentration having purified water and methanol mixed therein, 2,2',3,3', 3'-hexahydroxy-2,2'-bi-indan-6-methoxy-1,1'-dion shown in the following structural formula (B) was dissolved by 1 wt. % as antifreeze, and a fuel for a fuel cell was prepared.

(B)

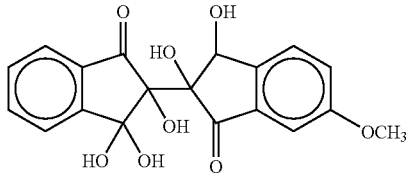

EXAMPLE 6

In an aqueous methanol solution of 5 wt. % concentration having purified water and methanol mixed therein, 2,2',3,3', 3'-hexahydroxy-2,2'-bi-indan-6-methoxy-1,1'-dion shown in the following structural formula (B) was dissolved by 0.2 wt. % as an antifreeze, and a fuel for a fuel cell was prepared.

EXAMPLE 7

In an aqueous methanol solution of 5 wt. % concentration having purified water and methanol mixed therein, 2,2',3,3', 3'-hexahydroxy-2,2'-bi-indan-6-methoxy-1,1'-dion shown in the above structural formula (B) was dissolved by 3 wt. % as an antifreeze, and a fuel for a fuel cell was prepared.

EXAMPLE 8

In an aqueous methanol solution of 15 wt. % concentration having purified water and methanol mixed therein, 2,2',3,3', 3'-hexahydroxy-2,2'-bi-indan-6-methoxy-1,1'-dion shown in the above structural formula (B) was dissolved by 10 wt. % as an antifreeze, and a fuel for a fuel cell was prepared.

EXAMPLE 9

In an aqueous methanol solution of 10 wt. % concentration having purified water and methanol mixed therein, 2,2',3,3', 3'-hexahydroxy-2,2'-bi-indan-6-carboxy-1,1'-dion shown in the following structural formula (C) was dissolved by 1 wt. % as an antifreeze, and a fuel for a fuel cell was prepared.

(C)

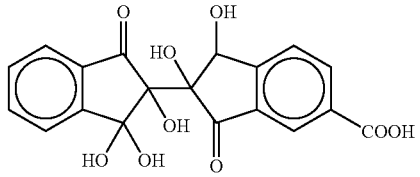

EXAMPLE 10

In an aqueous methanol solution of 5 wt. % concentration having purified water and methanol mixed therein, 2,2',3,3', 3'-hexahydroxy-2,2'-bi-indan-6-carboxy-1,1'-dion shown in the above structural formula (C) was dissolved by 0.2 wt. % as an antifreeze, and a fuel for a fuel cell was prepared.

EXAMPLE 11

In an aqueous methanol solution of 5 wt. % concentration having purified water and methanol mixed therein, 2,2',3,3', 3'-hexahydroxy-2,2'-bi-indan-6-carboxy-1,1'-dion shown in the above structural formula (C) was dissolved by 3 wt. % as an antifreeze, and a fuel for a fuel cell was prepared.

EXAMPLE 12

In an aqueous methanol solution of 15 wt. % concentration having purified water and methanol mixed therein, 2,2',3,3', 3'-hexahydroxy-2,2'-bi-indan-6-carboxy-1,1'-dion shown in the above structural formula (C) was dissolved by 10 wt. % as an antifreeze, and a fuel for a fuel cell was prepared.

COMPARATIVE EXAMPLE 1

In an aqueous methanol solution of 10 wt. % concentration having purified water and methanol mixed therein, propylene glycol (Industrial Propylene Glycol (trademark) of Mitsui Takeda Chemicals, Inc.) was dissolved by 1 wt. % as an antifreeze, and a fuel for a fuel cell was prepared.

<Assembling of Single Cell>

On one side of a perfluoroalkyl sulfone film (a Nafion 112 (trademark) film of Dupont), a platinum-ruthenium catalyst layer and a carbon powder-carbon paper diffusion layer were thermally bonded in this order, and an anode (fuel electrode) was formed. On the other side of the perfluoroalkyl sulfone film, a platinum catalyst layer and a carbon powder-carbon paper diffusion layer were thermally bonded in this order, and a cathode (air electrode) was formed. Thus, a membrane electrode with the electrode area of 5 $cm^2$ was fabricated. On both sides of the membrane electrode, a carbon-made separator having a column flow passage and a current collector were laminated in this order, and a single cell for evaluation was assembled by bolting.

<Evaluation of Single Cell>

The single cell was assembled in a fuel cell evaluation device having a freezing chamber. Fuels of Examples 1 to 12 and Comparative example 1 were supplied to the anode side of the single cell at a flow velocity of 5 mL/min, and air was supplied to the cathode side of the single cell at a flow velocity of 10 mL/min. The temperature of the freezing chamber was lowered from room temperature to −30° C., and a current-voltage characteristic of the single cell was observed at −10° C., −20° C., and −30° C. A voltage value at 200 mA/$cm^2$ is determined from the current-voltage characteristic, and an output voltage difference on the basis of Comparative example 1 was obtained. Results are shown in Table 1.

The current-voltage characteristic when the fuels of Example 1 and Comparative example 1 were applied to the single cell at −30° C. is shown in FIGURE.

TABLE 1

| | Antifreeze | Methanol concentration | Antifreeze concentration | Output voltage difference from Comparative example 1 (mV) −10° C. | −20° C. | −30° C. |
|---|---|---|---|---|---|---|
| Example 1 | Structural formula A | 10 | 1 | 20 | 30 | 40 |
| Example 2 | Structural formula A | 5 | 0.2 | 10 | 20 | 30 |
| Example 3 | Structural formula A | 5 | 3 | 25 | 35 | 45 |
| Example 4 | Structural formula A | 15 | 10 | 30 | 40 | 50 |
| Example 5 | Structural formula B | 10 | 1 | 25 | 35 | 45 |
| Example 6 | Structural formula B | 5 | 0.2 | 20 | 35 | 40 |
| Example 7 | Structural formula B | 5 | 3 | 35 | 45 | 55 |
| Example 8 | Structural formula B | 15 | 10 | 40 | 50 | 60 |
| Example 9 | Structural formula C | 10 | 1 | 15 | 25 | 35 |
| Example 10 | Structural formula C | 5 | 0.2 | 5 | 15 | 25 |
| Example 11 | Structural formula C | 5 | 3 | 20 | 30 | 40 |
| Example 12 | Structural formula C | 15 | 10 | 25 | 35 | 45 |
| Comparative Example 1 | Propylene glycol | 10 | 1 | 0 | 0 | 0 |

As is clear from Table 1, when power is generated with the fuel cell in a low temperature environment by using the fuels of Examples 1 to 12 having the organic compounds of the above structural formulas (A), (B) and (C) added and dissolved as an antifreeze in the aqueous methanol solution, a higher output voltage is obtained as compared with the case of using the fuel of Comparative example 1 having propylene glycol added thereto as an antifreeze.

As also known from FIGURE, the fuel of Example 1 produces higher output voltage in the low temperature environment of −30° C. as compared with the fuel of Comparative example 1.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the applied claims and their equivalents.

What is claimed is:

1. A fuel for a fuel cell comprising a mixed solution of water and methanol, and an organic compound represented by the following formula (II) dissolved in the mixed solution as an antifreeze:

(II)

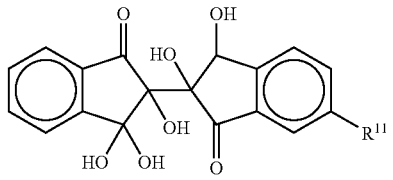

where $R^{11}$ denotes one of a carboxy group, an alkoxy group, or an ester group.

2. The fuel for the fuel cell, according to claim 1, wherein the methanol concentration of the mixed solution of water and methanol is 30 wt. % or less.

3. The fuel for the fuel cell, according to claim 1, wherein the methanol concentration of the mixed solution of water and methanol is 5 to 30 wt. %.

4. The fuel for the fuel cell, according to claim 1, wherein the alkoxy group denoted $R^{11}$ in the formula (II) has 1 to 20 carbon atoms.

5. The fuel for the fuel cell, according to claim 1, wherein the organic compound represented by the formula (II) is 2,2',3,3',3'-hexahydroxy-2,2'-bi-indan-6-methoxy-1,1'-dion, or 2,2',3,3',3'-hexahydroxy-2,2'-bi-indan-6-carboxy-1,1'-dion.

6. The fuel for the fuel cell, according to claim 1, wherein the organic compound is dissolved in the mixed solution by 10 wt. % or less.

7. The fuel for the fuel cell, according to claim 1, wherein the organic compound is dissolved in the mixed solution by 0.5 to 5 wt. %.

* * * * *